United States Patent [19]

Winkler

[11] 4,362,024

[45] Dec. 7, 1982

[54] PNEUMATICALLY OPERATED REFRIGERATOR WITH SELF-REGULATING VALVE

[75] Inventor: Otto C. Winkler, Balzers, Liechtenstein

[73] Assignee: Oerlikon-Buhrle U.S.A. Inc., New York, N.Y.

[21] Appl. No.: 227,190

[22] Filed: Jan. 22, 1981

[51] Int. Cl.[3] ..... F25B 9/00

[52] U.S. Cl. ..... 62/6; 137/625.37

[58] Field of Search ..... 62/6; 137/625.37, 625.34, 137/625.38, 625.35

[56] References Cited

U.S. PATENT DOCUMENTS 3,188,821 6/1965 Chellis ..... 62/6

4,294,077 10/1981 Sarcia et al. ..... 62/6

4,294,600 10/1981 Sarcia et al. ..... 62/6

*Primary Examiner*—Ronald C. Capossela

*Attorney, Agent, or Firm*—Schiller and Pandiscio

[57] ABSTRACT

A self-regulating fluid operated valve system for a "no-work" refrigerator comprises a spring loaded pilot valve, connected to and acting against the pressure in the refrigerator chamber, provided with a throttling section which may be connected alternatively to the fluid supply or the fluid exhaust by a second valve moving with the displacer. The pilot valve also has a section which makes alternative connection between the refrigeration chamber and the supply of compressed refrigerant during the fully pressurized portion of the cycle. The valving connected to the displacer is in the form of a spool valve incorporated into the piston and so arranged that its low pressure section is between its high pressure section and the refrigeration chamber.

8 Claims, 4 Drawing Figures

PNEUMATICALLY OPERATED REFRIGERATOR WITH SELF-REGULATING VALVE

BACKGROUND OF THE INVENTION

This invention relates to refrigeration apparatus of the type in which an expansible compressed fluid is subjected to a thermodynamic cycle, and more specifically to reciprocating regenerative refrigerators in which the reciprocating member is driven by the fluid and both the reciprocating motion and the thermodynamic cycle are controlled by a self-regulating fluid operated valve system.

Valved reciprocating refrigerators are well known. Typical of these is the Gifford-McMahon refrigerator, in which a pair of variable volume chambers, defined by opposite faces of a reciprocating displacer and the enclosing cylinder within which the displacer slidably fits, are connected together through a regenerator. Reciprocation of the displacer forces the fluid back and forth through the regenerator. One of the two chambers is connected, through appropriate valving, to a source of the pressurized fluid and to an exhaust. Synchronization of these valves with the reciprocation of the displacer allows the apparatus to be filled with a charge of compressed fluid, which is then forced in one direction through the regenerator, next allowed to expand, and finally forced back through the regenerator. The energy loss of the fluid due to its expansion is available to cool a thermal load, the expanded fluid being forced through the regenerator, where it takes up energy, at the end of the exhaust phase of each cycle. The regenerator in turn cools the next charge of compressed fluid before the latter is allowed to expand. In steady state operation, a large temperature differential may be developed across the regenerator, and as a consequence such refrigeration apparatus may be used to develop very low temperatures while both the supply of compressed fluid and the exhausted expanded fluid are near room temperature.

The expanding fluid works against itself, not a piston (for this reason, such apparatus are often referred to as "no work" machines), the purpose of the displacer being merely to move the fluid back and forth through the regenerator once each cycle. An external source of power is required to move the displacer in close synchronization with the opening and closing of the supply and exhaust valves. While both displacer and valving may be operated electromechanically, a particularly convenient system incorporates a driving mechanism for the displacer in the form of a small piston engine driven by the fluid, and mechanically coupled and fluid actuated valving. Such apparatus is disclosed in U.S. Pat. No. 3,188,821.

Optimum heat exchange in the regenerator requires the fluid velocity in the regenerator to be constant. This requires constant velocity displacement of the displacer during the constant pressure phases of the cycle and constant pressure rise (or fall) rate during the constant displacement phases, with strict synchronization between the phases. While prior art fluid driven displacers evidence the requisite constant displacement velocity, it has proved more difficult to achieve the desired constant rate of pressure change and also the desired exact synchronization, particularly with the mechanically least complex valve systems.

An additional problem which the simplest fluid operated self-regulating valve systems encounter arises from the nature of the valve mechanism, which typically includes a pressure centered pilot spool valve. In the absence of a fluid flow (as for instance, when the refrigerator is shut down), the position of the valve is indeterminate, and automatic starting of the refrigerator is therefore not assured simply by connecting the refrigerator to a source of pressurized fluid.

Yet another problem associated with prior art fluid driven valve systems is caused by leakage of the compressed fluid between the refrigerator chambers and the piston drive chamber. Such leakage results in a less than optimum operating cycle, and has generally been solved in the prior art by the use of seals and close mechanical tolerances, with a resulting increase in friction and a larger required driving force, as well as increased cost.

OBJECTS OF THE INVENTION

Accordingly, it is an object of the present invention to realize a self-regulating fluid operated valving system for valved reciprocating refrigerators which is both mechanically simple and provides for a substantially constant rate of pressure change during the thermodynamic cycle.

Additionally, it is an object of the invention to provide in a valved reciprocating displacer refrigerator a valving system which provides the desired exact synchronization between displacer location and pressure variation.

Further, it is an object of the present invention to provide a valving system for such applications in which the valve status is determinate when the system is not connected to a supply of pressurized fluid, in order to insure automatic starting of the refrigerator.

Yet another object of the present invention is to provide a valving system which incorporates features to minimize adverse effects of leakage between refrigeration and drive chambers, thus avoiding tight fitting seals and close tolerances between the piston and the drive chamber, thereby reducing friction, required drive power, and cost.

SUMMARY OF THE INVENTION

These and other objects are met in the present invention of a self-regulating fluid operated valve system in which a spring loaded pilot valve, connected to and acting against the pressure in the refrigerator chamber, is provided with a throttling section which may be connected alternatively to the fluid supply or the fluid exhaust by a second valve moving with the displacer. The pilot valve is so spring loaded as to assume the position in which the throttle is wide open to exhaust through, and almost closed to a supply from, the second valve when the pressure in the refrigerator chamber is a minimum. Full pressure in the refrigeration chamber coincides with a fully opened throttle to supply and a barely opened exhaust. The second valve is disposed to alternatively connect the exhaust and fluid supply to the throttle section at the extremes of the displacer's motion. Additionally, the pilot valve serves to directly connect the drive piston of the displacer alternatively to the refrigerant fluid source.

It will be appreciated that the throttling section of the pilot valve may be configured to give any desired rate of pressure change as a function of the instantaneous pressure in the refrigeration chamber, and that, in particular, a linear change in pressure as a function of time may be achieved. It will also be recognized that, by slaving the pressure supplied via the throttling valves to the displacer and providing adjustment between the throttling section of the pilot valve (controlling the refrigeration chamber pressure) and the other sections of the pilot valve (controlling the drive motor), the desired synchronization is provided. It will also be appreciated that the use of a spring loaded pilot valve controlling both refrigeration chamber pressure and displacer driving piston insures a determinate position of the valving controlling the displacer drive when the system is disconnected, thereby insuring ready starting.

The present invention also provides the pilot valve with a section which makes alternative connection between the refrigeration chamber and the supply of compressed refrigerant during the fully pressurized portion of the cycle. Additionally, the valving connected to the displacer is preferably in the form of a spool valve incorporated into the piston and so arranged that its low pressure section is between its high pressure section and the refrigeration chamber. These two features minimize the adverse effects of leakage thereby insuring a constant pressure in the refrigeration chamber during displacer motion.

Other objects of the invention will in part be obvious and in part appear hereinafter. The invention accordingly comprises the apparatus possessing the construction, combination of elements, and arrangement of parts which are exemplified in the following disclosure, and the scope of the application of which will be indicated in the claims.

BRIEF DESCRIPTION OF THE DRAWINGS

For a fuller understanding of the nature and objects of the present invention, reference should be had to the following detailed description taken in connection with the accompanying drawings wherein.

In all figures like numbers refer to like components.

Figure 1:
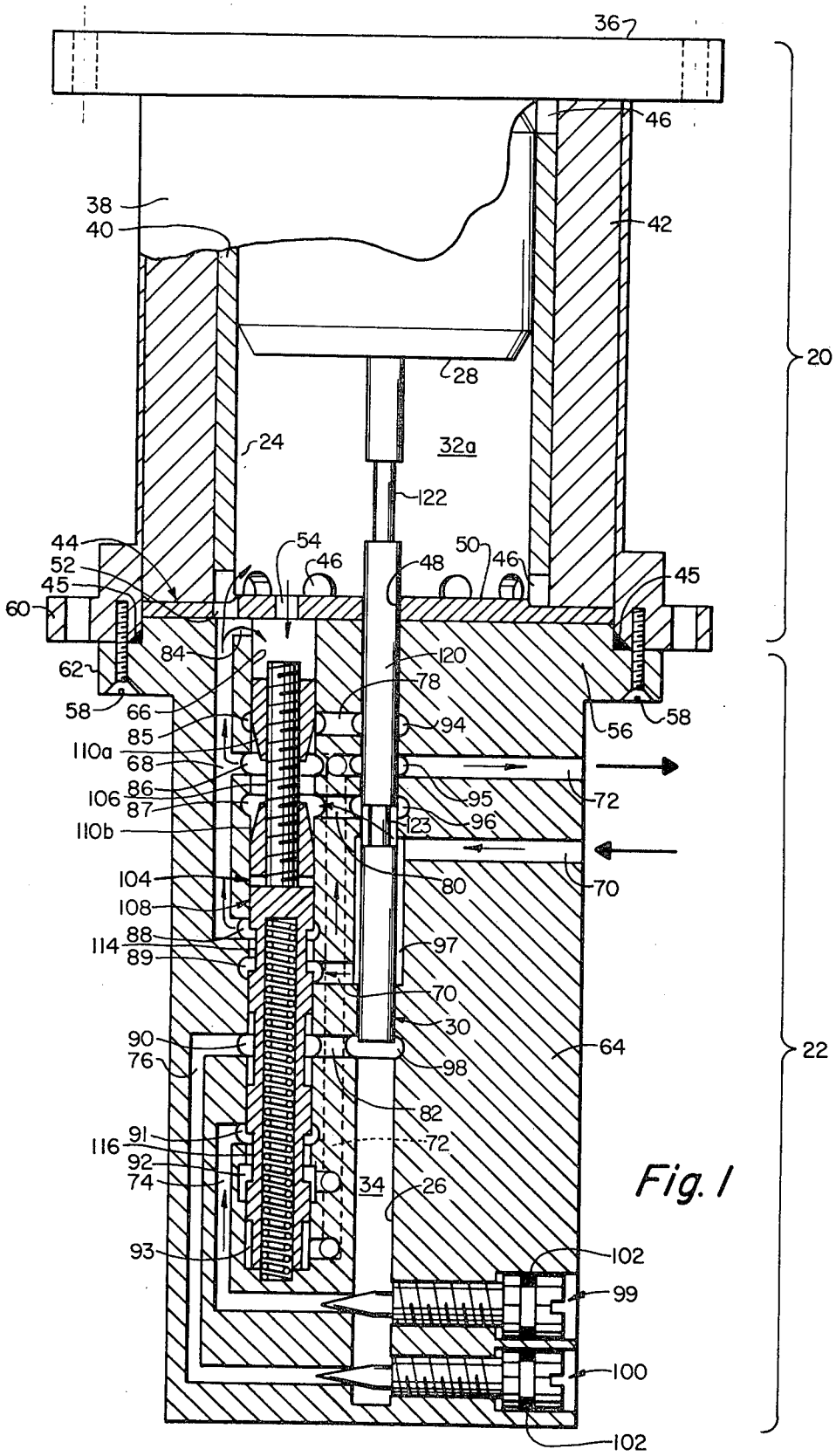
FIG. 1 shows a preferred embodiment of a refrigerator, partially in cross-section, constructed in accordance with this invention and incorporating a preferred embodiment of the valve system, the components of the refrigerator and valve systems being shown in one extreme position as occurs during the operating cycle of the invention.

With respect to terminology, in the following detailed description portions of the apparatus are referred to as "upper" and "lower" portions. This is done wholly for convenience and to most easily relate the discription to the representations in the drawings. It should be understood that the apparatus can function in any position and it is within the scope of this invention to have it do so.

DETAILED DESCRIPTION

Figure 2:
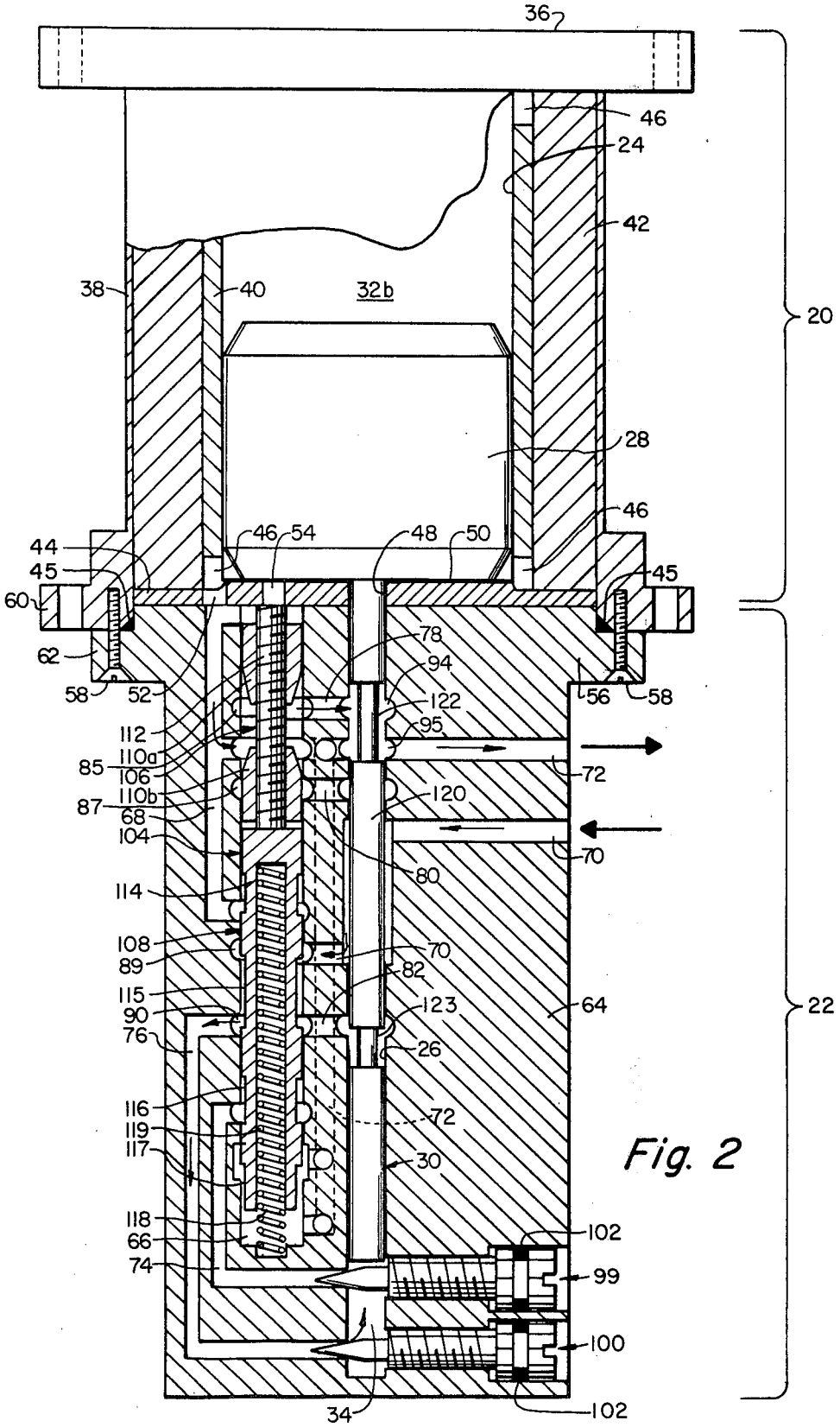
FIG. 2 is a view similar to FIG. 1, the components of the refrigerator and valve system being shown in the opposite extreme positions to the situation depicted in FIG. 1.

Referring to FIGS. 1 and 2, there may be seen a valved reciprocating Gifford-McMahon type refrigerator provided with a self-regulating valve system made in accordance with the principles of the present invention. The refrigerator comprises cold head 20 and drive head 22. Cold head 20 and drive head 22 are each provided with a bore, designated 24 and 26 respectively, preferably of right circular cylindrical form, in which are disposed respectively a displacer 28 and a smaller diameter piston 30, as will be more fully described hereinafter. Bores 24 and 26 are preferably coaxial, and in a preferred form of the refrigerator, cold head 20 and drive head 22 are joined end-to-end so as to have a common axis. Cold head 20 and drive head 22 are fabricated of material relatively impervious to the fluid to be used in the refrigeration cycle, in order that bores 24 and 26 may define, in part, fluid tight chambers, designated generally by numerals 32 (a and b) and 34 respectively. As will be more fully described hereinafter, the thermodynamic cycle producing refrigeration takes place in cold head 20, the upper portion of the cold head (i.e., to portion uppermost in the figures) being at the lowest temperature. Consequently, the refrigerator is commonly connected to its thermal load either by directly contacting the upper end of the cold head to the load or via a heat exchanger (not shown) wrapped, for instance, about this end of the cold head.

Considering in greater detail the structure of cold head 20, in a preferred embodiment its fixed parts comprise end plate 36, outer wall 38, cylindrical liner 40, regenerator 42, lower end plate 44 and gasket 45. The upper end of cold head 20 is defined by end plate 36. End plate 36 is a planiform circular plate, impervious to the fluid and typically of a relatively high thermal conductivity material, such as copper, to facilitate heat transfer from a thermal load attached thereto. Depending from end plate 36, and substantially normal to the plane of the plate, is outer wall 38. Outer wall 38 is a thin hollow right circular cylindrical tube, which, like end plate 36 is also of a material impervious to the fluid but preferably is of relatively lower thermal conductivity. In a preferred embodiment, outer wall 38 is of stainless steel. End plate 36 and outer wall 38 are joined together with a fluid-tight seal, as by welding or brazing.

Concentrically situated within outer wall 38 is a cylindrical liner 40. Liner 40 defines bore 24, and is a hollow right circular cylindrical tube having an axial extent somewhat less than that of outer wall 38 and an outer diameter so chosen as to allow clearance between it and the outer wall sufficient for regenerator 42 (to be described). Liner 40 is preferably a polymer having a low thermal conductivity and good lubricating qualities, such as nylon filled with a lubricant such as molybdenum disulfide. The upper and lower ends of liner 40 are provided with a number of apertures 46, each passing through the wall of the liner and intersecting the adjacent edge of the liner, as shown. Apertures 46 are preferably equally spaced about the circumference of the liner adjacent its ends, and are numbered and sized to offer little impediment to the flow of fluid during operation of the refrigerator, yet permitting the retention of the matrix of regenerator 42, as will be understood by those skilled in the art.

Regenerator 42 occupies a cylindrical volume between outer wall 38 and liner 40. Regenerator 42 consists of a material of high heat capacity (typically a metal) arranged in a foraminous matrix designed to offer little resistance to the passage of the refrigerant fluid yet expose to the fluid a large surface area in a small volume. The regenerator may thus consist of packed spheres or wire mesh, and is commonly fabricated from bronze, copper, or lead. The axial extent of regenerator 42 is preferably the same as that of liner 40.

Lower end plate 44 is in the form of a thin circular substantially flat plate with an outside diameter equal to the internal diameter of outer wall 38. The lower end plate is provided with a central aperture 48 sized to accept piston 30. As an aid in locating liner 40, the upper side of end plate 44 may be provided with a circular boss 50 having the same diameter as the inside diameter of the liner. Alternatively, the upper face of end plate 44 might be trepanned at this diameter about aperture 48 with a groove the width of liner 40. End plate 44 is also provided with a fluid conductive aperture 52 at a radius equal to that of liner 40. The liner is disposed so that one of its apertures 46 is coincident with aperture 52. An additional pilot aperture 54, at a radius less than that of aperture 52, and preferably radially aligned therewith, is also provided.

Displacer 28 is of right circular cylindrical form and has a diameter slightly smaller than the inside diameter of liner 40 so as to make a close sliding fit with the liner. Displacer 28 has an axial extent less than that of the liner. Displacer 28 is so disposed as to be capable of reciprocating motion back and forth in liner 40 between end plates 36 and 44. Displacer 28 is fabricated of a material having a low thermal conductivity, and is mechanically attached to piston 30, which in the preferred embodiment is a substantially uniform diameter rod depending coaxially from the lower surface of displacer 28. It will be understood that piston 30 must necessarily have an axial extent (i.e., length) in excess of the difference between those of cylindrical liner 40 and displacer 28. In a preferred embodiment, piston 30 incorporates spool valve 120 alternatively connecting two pairs of valve ports, to be described, and accordingly its length must also accommodate the length of the valve.

Cold head 20 is assembled with regenerator 42 held tightly between outer wall 38 and liner 40 and between end plates 36 and 44, and with displacer 28 slidably captive within liner 40 with piston 30 extending through aperture 48 of lower end plate 44. In a preferred embodiment, assembly is effected by a tight fit of a portion 56 of drive head 22 dimensioned to fit internally within outer wall 38, the assembly being held together, as by machine screws 58 connecting opposing flanges 60 and 62 on cold head 20 and drive head 22 respectively. Gasket 45, a rubber or similar elastomeric annular seal seated between opposing flanges 60 and 62, seals cold head 20 to drive head 22 in a pressure tight manner.

It will be recognized that the apparatus so far described is that of a typical refrigeration section of a Gifford-McMahon type refrigerator, chamber 32 (defined by end plate 36, liner 40, and end plate 44) being divided by displacer 28 into complementary variable sized lower (ambient) and upper (cold) chambers, **32*a* and 32*b* respectively. Motion of displacer 28 between the limits formed by end plates 36 and 44 acts to circulate any fluid present in lower and upper chambers 32*a* and 32*b* back and forth between the chambers through the fluid path provided by the foraminous matrix of regenerator 42. It will also be appreciated that the arrangement of components in cold head 20 might be different without materially affecting the principles of operation of the unit (e.g., the regenerator might be a separate unit remote from chambers 32*a* and 32*b* or it might be incorporated into displacer 28**).

Turning now to drive head 22, its body 64 is of substantially right circular cylindrical form. Body 64 is made of a rigid material impervious to the fluid to be used and is provided with a plurality of interconnected channels in the form of bores 26 and 66, transfer manifold 68, high pressure inlet manifold 70, low pressure exhaust manifold 72, drive chamber exhaust conduit 74, drive chamber supply conduit 76, throttle exhaust conduit 78, throttle supply conduit 80, and drive chamber high pressure bypass conduit 82.

Bore 26 is sized so as to make a close sliding fit with piston 30, and is substantially coaxial with body 64. It is preferably in the form of a blind bore extending from the upper end of body 64 toward the lower end by a distance greater than the length of piston 30 measured from displacer 28 sufficient to accommodate the connection of drive chamber exhaust and supply conduits 74 and 76, respectively, in the manner described hereinafter. The lower portion of bore 26 in part defines drive chamber 34 while the upper portion serves as a spool valve bore.

Bore 66 serves as a pilot valve bore, and in this preferred embodiment it is a blind cylindrical bore extending into body 64 from the top and parallel to bore 26. Bores 26 and 66 are aligned respectively with apertures 48 and 54 in end plate 44, and the diameter of bore 66 is preferably chosen to be greater than that of aperture 54. The length of bore 66 may be any convenient length provided it is sufficient to accommodate a set of ten spaced-apart ports identified in the drawings and in the following description by the consecutive numbers 84 through 93.

Manifolds 68, 70 and 72 and conduits 74, 76, 78, 80 and 82 are all fluid conductive paths variously communicating between bores 26 and 66 and the exterior of body 64. Preferably they are all dimensioned to have equal and circular cross-sections sufficient to produce minimal resistance to the flow of refrigerant, as will be understood by those skilled in the art. It will be further understood that these fluid conductive paths may be either formed in a unitary body 64 as illustrated, or may comprise individual sections of conduit connecting together separate cylinders accommodating bores 26 and 66.

Transfer manifold 68 is preferably disposed coplanar to the axes of bores 26 and 66 and is spaced from bore 66 a distance such that the manifold may communicate through aperture 52 in lower end plate 44 with the interior of the cold head. Manifold 68 also communicates, via ports 84, 86, and 88, with the interior of bore 66, as described further below.

Inlet manifold 70 is adapted to be connected to a source of compressed refrigerant, e.g., the discharge port of a compressor (not shown), and communicates with bores 26 and 66, as will also be described. Exhaust manifold 72 communicates between bores 26 and 66 and a fluid exhaust, e.g., the intake port of a compressor (not shown). All of the conduits 74, 76, 78, 80 and 82 communicate between bores 26 and 66.

As is shown in FIGS. 1 and 2, a plurality of flow paths are provided by the various ports, manifolds, and conduits associated with bore 66. Referring to FIG. 1, it may be seen that from the uppermost to the lowermost port on bore 66, these connections are as follows: port 84 provides access to transfer manifold 68; port 85, to throttle exhaust conduit 78; port 86, to transfer manifold 68; port 87, to throttle supply conduit 80; port 88, to transfer manifold 68; port 89, to inlet manifold 70; port 90 to drive chamber supply and bypass conduits 76 and 82 respectively; port 91 to exhaust conduit 74; and ports 92 and 93, each to exhaust manifold 72. Ports 85, 86 and 87 are consecutively spaced apart from one another by a distance substantially equal to the diameter of an individual fluid conduit, e.g., conduit 78. A similar spacing is provided between ports 88 and 89 and 91 and 92. The remaining spacings between ports are somewhat larger to accommodate the operation and adjustment of pilot valve 104 as will be described. Ports 84 and 93 are situated immediately adjacent opposite ends of bore 66.

Similarly denoting in numerical order from the uppermost the ports defined by the junction of the various manifolds and conduits with bore 26, port 94 connects with throttle exhaust conduit 78; 95, with exhaust manifold 72; 96, with throttle supply conduit 80; 97, with inlet manifold 70; and 98, with bypass conduit 82. Ports 94, 95, 96 and 97 are all spaced apart by equal distances substantially on the order of the diameter of a conduit, e.g., conduit 78. Preferably, but not necessarily, ports 94 and 96 are so situated that conduits 78 and 80, respectively joining these respective ports to ports 85 and 87 in bore 66 may be straight paths normal to the bores. Port 98 is located a distance from the upper open end of bore 26 equal to the length of piston 30 measured from displacer 28, less the sum of the thickness of gasket 44 and the length of chamber 32*a*.

All of the ports may be mere apertures between the respective bore and manifold or conduit, but preferably, as shown, they are in the form of circumferential grooves about the respective bore. With the exception of port 97, the axial extent of each port along the respective bore is preferably the same as the diameter of its associated fluid path, and preferably, all are equal. In the embodiment illustrated, port 97 extends along bore 26 to connect two portions of manifold 70, although it will be appreciated that this connection might be otherwise made.

Drive chamber exhaust and supply conduits, 74 and 76 respectively, are connected to and communicate with the interior of bore 26 through needle valves, 99 and 100 respectively. In a preferred embodiment, needle valves 99 and 100 are disposed substantially normal to the axis of bore 26 and are located far enough from the upper (open) end of bore 26 as not to interfere mechanically with the downward stroke of piston 30. Needle valves 99 and 100 are of conventional design, and are adapted to being adjusted while the refrigerator is in operation. Inasmuch as they breach a pressurized system, needle valves 99 and 100 are preferably each provided with a pressure seal in the form of an O-ring 102.

A pilot spool valve 104 is mounted in bore 66. The outside diameter of the valve is chosen so as to achieve a relatively fluid-tight sliding fit with bore 66. The overall length of the valve is chosen to be shorter than that of bore 66 by twice the axial extent (i.e., the diameter) of a port, typified by port 90. As may be seen by reference to FIG. 2, spool valve 104 comprises adjustable spool section 106 and standard spool section 108 coaxially connected end to end.

Spool valve section 106 comprises a pair of valve members in the form of conical bushings 110*a* and 110*b* threaded onto threaded stem 112, which is attached to standard spool section 108. Each bushing 110 is in the form of a frustum of a right circular cone, having it larger base common to a connected right circular cylinder, the whole being provided with a coaxial central threaded bore. The altitude of each conical frustum is preferably on the order of (i.e., one to two times) the axial extent of a port typified by port 90. The axial extent of a single conical bushing 110 is preferably at least twice this dimension. The pair of conical bushings 110 are threaded onto stem 112 so that the conical portions of the bushings face one another; they are positioned along stem 112 such that when spool valve 104 is in its lowermost position (as shown in FIG. 1), with standard spool section 108 resting on the blind end of bore 66, the uppermost bushing 110*a* is between ports 84 and 85 and almost completely obstructs port 85, while lowermost bushing 110*b* is between ports 87 and 88 and is just clear of port 87. The taper of conical bushings 110 and the clearance between stem 112 and bore 66 are selected to provide free fluid flow through a pair of adjacent fully open ports, e.g., as between ports 86 and 87 in FIG. 1 or ports 85 and 86 in FIG. 2, as will be understood by those skilled in the art.

Standard spool section 108 comprises coaxial sections 114, 115, 116 and 117, each having a diameter smaller than bore 66 sufficient to permit unobstructed fluid flow between communicating adjacent ports, e.g., as between ports 89 and 90 via section 115 as shown in FIG. 2. Sections 114, 116 and 117 each have an axial extent (length) of substantially twice the axial extent (the diameter) of a port typified by port 90. Section 115 has an axial extent substantially equal to the center-to-center distance between ports 89 and 90. Those portions of spool section 108 which are between sections 114, 115, 116 and 117 have an axial extent equal at least to that of a port typified by port 90. Sections 114, 115, 116 and 117 are disposed along spool section 108 such that when section 108 is resting on the blind end of bore 66 (FIG. 1), section 114 is disposed midway between and uncovering ports 88 and 89, section 115 is centered on port 90, and section 116 is disposed midway between and uncovers ports 91 and 92. Section 117 is counterminous with the lower end of section 108. These sections are also disposed, in view of the overall length of spool valve 104, such that when stem 112 is in contact with lower end plate 44 (FIG. 2) section 115 is midway between and uncovers ports 89 and 90 while sections 114 and 116 no longer uncover ports 89 and 92, respectively.

Spool valve 104 is spring-loaded with a compression spring 117 which engages the lower end of bore 66 and extends into a blind bore 119 in spool section 108. The spring produces a force variable over the travel of the spool valve. This spring force varies over the range of forces produced by the pressure of the refrigerant in cold head 20 acting over an area equal to the circular cross-section of bore 66. When the cold head is fully pressurized, the spring experiences maximum compression. When the cold head is fully exhausted, the spring is fully extended.

Piston 30 is a rod-shaped member having a pair of small diameter sections 122 and 123 demarcating a second spool valve 120. As with sections 114, 115, 116, and 117 of pilot spool valve 104, sections 122 and 123 are of a diameter sufficiently small to permit free fluid flow between communicating adjacent ports, such as ports 96 and 97 in FIG. 1 and ports 94 and 95 in FIG. 2. Section 122 has an axial extent (length) on the order of at least three times the axial extent (diameter) of a port (e.g., port 90) and is so disposed that when displacer 28 is in its lowermost position adjacent and confronting lower end plate 44 (FIG. 2) section 122 is disposed between and uncovering ports 94 and 95. Section 123 has an axial extent substantially equal to twice the axial extent of port 90 and is so disposed that when displacer 28 is in its uppermost position adjacent and confronting end plate 36 (FIG. 1) section 123 is midway between and uncovering ports 96 and 97.

Figure 3:
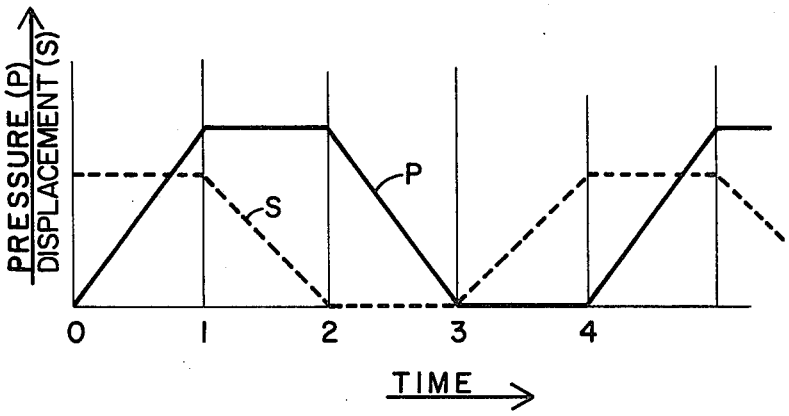
FIG. 3 is a simplified representation of the operational sequence, showing the preferred displacement of the displacer and variation in pressure in the refrigerator throughout a cycle.

The operation of the apparatus of FIGS. 1 and 2 may be most readily understood with reference to FIG. 3. FIG. 3 is an idealized representation of the displacement S of displacer 28 and the fluid pressure P in chambers 32*a* and 32*b* as a function of time, arbitrarily starting with the displacement at its maximum value (i.e. with displacer 28 in its uppermost position adjacent and confronting end plate 36) and the pressure at its minimum value at time 0. During the first phase of the cycle, desirably displacement remains constant while pressure rises linearly with time, reaching its maximum value at time 1. In the next phase, between time 1 and time 2, the pressure remains constant while ideally the displacement linearly decreases with time. Between time 2 and time 3, displacement remains constant at its minimum value (displacer 28 adjacent lower end plate 44), while pressure decreases linearly with time. In the last phase, from time 3 to time 4, pressure remains constant at its minimum value while displacement linearly increases. It will be appreciated that the depiction in FIG. 3 is idealized and that, in particular, the four phases of the cycle need not all take equal times. Further, it will be appreciated that minor irregularities in both the linearity and phase relationship between the displacement and pressure curves will occur in practice. Nevertheless, the closer the refrigerator approaches the linearity and phase relationship of the cycle depicted in the figure, the closer it approaches optimum refigeration capacity.

The situation depicted in FIG. 1 corresponds to the instant at time 1 in FIG. 3. Displacer 28 is at its uppermost position and the pressure in cold head 20 is a maximum. The upper end of pilot spool valve 104 is exposed, through pilot ports 54 and 84 respectively in lower end plate 44 and body 64, to the fluid pressure in chamber 32*a* of the cold head and in transfer manifold 68 connected thereto. Section 117, defining the lower end of pilot valve 104, communicates via port 93 with the low pressure fluid in exhaust manifold 72. Consequently, at maximum cold head pressure, the pressure differential acting axially along pilot spool valve 104 is such as to compress spring 118 and force the valve into its lower position, bottoming the valve out against the blind end of bore 66. In this position, chamber 32*a* and regenerator 42 are connected to inlet manifold 70 via aperture 52, transfer manifold 68, and pilot spool valve section 114, while drive chamber 34 is connected to exhaust manifold 72 via needle valve 99, exhaust conduit 74, and pilot spool valve section 116. At this instant, adjustable section 106 of pilot spool valve 104 simultaneously fully connects chamber 32*a* to inlet manifold 70 via transfer manifold 68, throttle supply conduit 80, and piston spool valve section 123. Also at this instant pilot spool valve section 106 partially connects throttle exhaust conduit 78 and chamber 32*a* via the almost completely obstructed port 85 (although it will be recognized that exhaust conduit 78 is closed off at its other end by piston connected spool valve 120). Piston connected spool valve 120 is in its uppermost position, connecting throttle supply conduit 80 with inlet manifold 70 through section 123. The remaining valve connections of the two spool valves are all closed.

With this disposition of the valving, drive chamber 34 is slowly exhausted through needle valve 99. Both faces of displacer 28 are at substantially the same high pressure as chambers 32*a* and 32*b* are in communication through apertures 46 and regenerator 42. However, the area of displacer 28 exposed to chamber 32*a* is smaller than the area exposed to chamber 32*b* by the cross-sectional area of piston 30. Piston 30 sees the force due to the pressure in drive chamber 34, which is being exhausted through needle valve 99. As a result, displacer 28 and piston 30 are accelerated downward at a rate regulated by the setting of needle valve 99. Downward movement of the displacer forces fluid from chamber 32*a* to chamber 32*b* via regenerator 42.

As displacer 28 and piston 30 move downward, the connection between inlet manifold 70 and throttle supply conduit 80 through section 123 of spool valve 120 is broken. However, high pressure fluid is still available to the interior of cold head 20 via section 114 of pilot spool valve 104. It will be appreciated that this arrangement maintains the pressure of chambers 32*a* and 32*b* during the motion of displacer 28 despite any leakage, as for instance might be caused by a loose fit between piston 30 and bore 26. This feature allows for such a loose fit, and consequently permits simpler construction of piston and bore, with less friction between them, than do conventional designs in which the valving of the refrigerator chambers is controlled primarily through the displacement of the displacer.

The high pressure in the cold head is maintained until displacer 28 reaches its lowermost limit, minimizing the volume of lower chamber 32*a* and maximizing the volume of chamber 32*b*. This is the instant represented by time 2 in FIG. 3. As displacer 28 and piston 30 reach this limit, spool section 122 of spool valve 120 comes opposite ports 94 and 95 in bore 26. This places exhaust manifold 72 in communication with throttle exhaust conduit 78, and the high pressure fluid in upper chamber 32*b*, regenerator 42, and transfer manifold 68 is now slowly bled through the throttle formed by port 85 and upper conical bushing 110*a*. As the pressure in cold head 20 and transfer manifold 68 drops, the downward force on pilot spool valve 104 decreases, and spring 118 urges the valve upward. Upper conical bushing 110*a* moves upward, further opening port 85. Simultaneously, the upward motion of spool section 114 closes off communication between transfer manifold 68 and inlet manifold 70, while upward motion of spool section 116 closes off communication, through exhaust conduit 74 and needle valve 99, between exhaust manifold 72 and drive chamber 34. It will be noted that the design described hereinabove requires an upward motion of pilot spool valve 104 from its bottomed-out lower position only of the order of one half the axial extent of a pilot spool valve port in order to effect these closures. As the upward motion of pilot spool valve 104 continues, the pressure in the cold head continues to decrease at a rate controlled by the further opening of the throttle formed by port 85 and the opposing conical bushing 110*a*. The pressure balance across displacer 28 and piston 30 continues to urge the displacer against its lower limit, maintaining constant displacement during the pressure drop in cold head 20. It is during this phase that cooling occurs.

When the pressure in cold head 20 reaches its minimum value, the axial pressure differential across pilot spool valve 104 becomes zero, and spring 118 forces the pilot spool valve into its uppermost position (shown in FIG. 2) with threaded stem 112 in contact with gasket 44. This situation corresponds to the instant at time 3 in FIG. 3. The throttle formed by port 85 and confronting conical bushing 110*a* is now fully open, and that formed by port 87 and confronting conical bushing 110*b* is nearly fully closed.

During the last portion of its motion, pilot spool valve 104 has brought section 115 between ports 89 and 90, connecting inlet manifold 70 with drive supply and bypass conduits, 76 and 82 respectively. Conduit 76 communicates with drive chamber 34 through needle valve 100. The resulting slow increase in pressure in drive chamber 34 urges piston 30 upward, the rate of motion of piston 30 and the connected displacer 28 being governed by needle valve 100. The upward motion of spool section 122 of spool valve 120 disconnects throttle exhaust conduit 78 from exhaust manifold 72. Chambers 32*a* and 32*b* remain at low pressure, however, as any leakage of high pressure fluid from drive chamber 34 to inlet manifold 70 between piston 30 and bore 26 is exhausted by port 95 to exhaust manifold 72 before it can leak into chamber 32*a*. Consequently, pilot spool valve 104, urged upward by spring 118, remains in contact with end plate 44 throughout the upward travel of displacer 28.

As the displacer reaches its upper limit, piston 30 clears port 98 (as shown in FIG. 1), and a secondary supply of high pressure fluid, unthrottled by needle valve 100, becomes available to drive chamber 34 via bypass conduit 82, pilot spool section 115, and inlet manifold 70. This secondary supply of high pressure fluid insures the positive positioning of displacer 28 against its upper limit, maximizing the volume of lower refrigerator chamber 32*a* and minimizing that of upper refrigerator chamber 32*b*, at the end of this phase of the cycle and throughout the next phase. Simultaneously, spool section 123 of piston-connected spool valve 120 becomes positioned between ports 96 and 97, and opens communication between inlet manifold 70 and throttle supply conduit 80.

The situation now corresponds to time 4 (or 0) of FIG. 3. The connection of the high pressure manifold to conduit 80 allows high pressure fluid to flow through the nearly closed throttle valve formed by port 87 and the opposing conical bushing 110*b*. High pressure fluid is slowly bled into transfer manifold 68 and through aperture 52 into lower refrigerator chamber 32*a* and regenerator 42. Pressure also increases in the upper portion of bore 66, which communicates with transfer manifold 68 and chamber 32*a* via pilot ports 84 and 54 respectively. As a result, an axial pressure difference begins building across pilot spool valve 104, urging the valve downward against the force of spring 118, thereby slowly opening the throttle formed by port 87 and opposing conical bushing 110*b*. During the initial phase of this motion of pilot spool valve 104, spool valve section 115 closes off the connection between inlet manifold 70 and conduits 76 and 82. Drive chamber 34 remains at high pressure, however, as any leakage between piston 30 and bore 26 places chamber 34 in communication with inlet manifold 70. Thus, displacer 28 is maintained at its upward limiting position while pressure in the cold head increases toward maximum.

When maximum pressure is reached, pilot spool valve 104 bottoms out against the blind end of bore 66. Spool section 114 opens communication between manifold 68 and high pressure manifold 70 while simultaneously spool section 116 opens communication between drive chamber exhaust conduit 74 and low pressure manifold 72. The throttle formed by port 87 and lower conical bushing 110*b* is fully open, and that between port 85 and upper conical bushing 110*a* is almost fully closed. The situation is now as depicted in FIG. 1 and corresponds to time 1 of FIG. 3, and the cycle is ready to repeat.

It will be appreciated that the valving system described herein has a determinant status in the event the refrigerator is disconnected from either a source of high pressure or a low pressure exhaust, as might be desirable either for the remote control of the refrigerator or as might occur with a portable refrigerator intended, for instance, to be connected to a source of pressurized fluid such as a compressed air line. In the absence of any pressure differential axially across pilot valve 104, spring 118 forces the valve into its uppermost position, into contact with end plate 44. In this position, spool section 115 opens communication between high pressure manifold 70 and drive chamber 34 via conduit 76 and needle valve 100. Connection of the refrigerator to a source of compressed refrigerant and an exhaust will, in this circumstance, drive piston 30 and displacer 28 toward their upper limits, despite any status of spool valve sections 122 and 123, as may for instance have resulted from the piston and displacer coasting at the termination of the refrigerator's last use or as a result of the orientation of the (non-operating) refrigerator. The situation then becomes as depicted at time 0 of FIG. 3, and the cycle may procede as previously described herein.

It will be appreciated that the throttling accomplished by the opposition of conical bushings 110*a* and 110*b* and ports 85 and 87 respectively permit control of the rate of pressure increase and decrease, and that the adjustment permitted by threading conical bushings 110 onto threaded stem 112 permits adjustment of the phasing between the pressure cycle, controlled by adjustable spool section 106, and the displacement, controlled by standard spool section 108.

Figure 4:
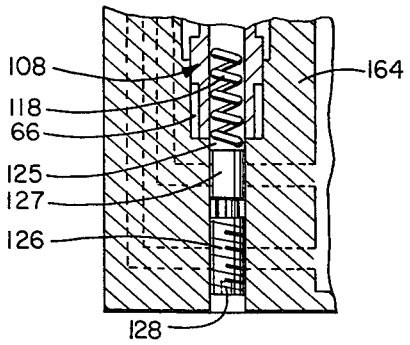
FIG. 4 is a fragmentary cross-sectional view of a portion of an alternative form of a pilot valve suitable for use with the present invention.

Various modifications may be made to the apparatus without changing the principles of operation. A particularly desirable feature in certain applications is provision for adjustment of the spring force acting on pilot valve 104. Such a modification is illustrated in FIG. 4, which shows in cross-section a fragment of body 164 of the refrigerator. Pilot valve bore 66 has been provided with a coaxial counterbore 125 which extends through body 164. Counterbore 125 is threaded at least in part, and a mating threaded full dog set screw 126 is provided. Preferably, screw 126 is recessed into body 164 and is provided with a tamper-proof socket 128, such as a specialized hex, Phillips, fluted, or similar socket. A cylindrical bushing 127 is provided between set screw 126 and spring 118, in order that no torsional forces are transmitted between spring and set screw. In all other respects, body 164 may be similar to body 64.

Certain other modifications may be made to the above described apparatus without departing from the scope of the invention. Thus, conical bushings 110 may be of more complex form than conic frustums in order to provide a non-linear throttling function, if desired. Further, it will be appreciated that ports 85 and 87 may be specially shaped and employed with cylindrical spool sections in place of conical bushings 110 to achieve similar controlled throttling. It will also be appreciated that the remaining valve sections and ports might employ similar throttling measures, in order, for instance, to avoid pressure surges in the fluid handling system. Additionally, it will be understood that port and spool valve dimensions may be varied, and that port and spool sections may be interchanged. Since these and other changes may be made in the above apparatus without departing from the scope of the invention herein involved, it is intended that all matter contained in the above description or shown in the accompanying drawings shall be interpreted in an illustrative and not in a limiting sense.

What is claimed is:

1. In a refrigeration apparatus operating on a compressed expansible fluid, comprising in combination:

cylinder means;

reciprocating means movable within said cylinder means between a first limit and a second limit and comprising a displacer mechanically joined to a piston, said displacer and said cylinder means together defining first and second refrigeration chambers of complementary variable volumes, and said piston and said cylinder means defining a driving chamber of variable volume, said displacer, piston, and cylinder means being so disposed that as said reciprocating means is moved from said first limit to said second limit said first chamber's and said driving chamber's volumes decrease from their maximum values to their minimum values while simultaneously said second chamber's volume increases from its minimum value to its maximum value;

a fluid path communicating between said first and second chambers and including a regenerator means;

a first fluid conductive manifold communicating between said first chamber and a plurality of ports of a first spool valve bore, one of said plurality of ports being a pilot port;

a first pair of fluid conductive conduits communicating between said driving chamber and individual ones of a second plurality of ports of said first spool valve bore;

a second pair of fluid conductive conduits communicating between individual ones of a third plurality of ports of said first spool valve bore and individual ports of a second spool valve bore;

a second fluid conductive manifold adapted to communicate with a high pressure source of said compressed fluid and further communicating with individual ports of said first and said second spool valve bores; and a third fluid conductive manifold adapted to communicate with means for exhausting said compressed fluid and further communicating with individual ports of said first and second spool valve bores;

the improvement comprising in combination:

a spring-loaded pilot spool valve configured and dimensioned to fit in said first spool valve bore and to be movable from a first position to a second position in response to fluid pressure in excess of a predetermined fluid pressure and to otherwise be urged toward said first position, said pilot spool valve being provided with (1) a first spool section configured and dimensioned to connect said first manifold alternatively with (a) a first one and (b) a second one of said second pair of fluid conductive ports, (2) a second and a third spool section configured and dimensioned to cooperatively act to connect said second manifold alternatively to (a) said first manifold and (b) one of said first pair of conduits, and (3) a fourth spool section configured and dimensioned to (a) connect and (b) disconnect the other one of said first pair of conduits to said third manifold; each respectively according to the location of said pilot spool valve in said (a) second and (b) first position; and a second spool valve mechanically joined to said reciprocating means and configured and dimensioned to movably fit within said second spool valve bore, said second spool valve being provided with a pair of spool sections configured and dimensioned to (1) connect said third manifold with said second one of said second pair of conduits only when said reciprocating means is substantially at said second limit and (2) connect said second manifold with said first one of said second pair of conduits only when said reciprocating means is substantially at said first limit.

2. The improvement according to claim 1 wherein further said first spool section and said second pair of fluid conductive ports form a pair of complementary throttle valves, having openings which vary in a predetermined manner from a minimum to a maximum in accordance with the location of said pilot spool valve.

3. The improvement according to claim 2 wherein said first spool section comprises a pair of coaxial opposed conical frustums.

4. The improvement according to claim 1 wherein said first, second, third, and fourth spool sections are held together in adjustable spaced apart relationship such that at least the separation between said first spool section and said second, third and fourth spool sections may be varied.

5. The improvement according to claim 3 wherein further at least one of said pair of conical frustums may be axially moved relative to the other.

6. The improvement according to claim 1 wherein further said spring loaded pilot spool valve is provided with an adjustable loading spring.

7. The improvement according to claim 1 wherein further said second spool valve is integral with said piston and said second spool valve bore is integral with said cylinder means, and said ports through which said second and third manifolds communicate with said second spool valve bore are disposed with said third manifold's port between said second manifold's port and said first and second chambers.

8. The improvement according to claim 1 and further including regulating valves on said first pair of conduits limiting flow of fluid into and out of said drive chamber and a by pass conduit on said one of said first pair of conduits connected to said second manifold when said pilot spool valve is in said second position, said by pass conduit communicating between said one conduit and a port in said driving chamber immediately clear of said piston when said reciprocating means is at said first limit.

* * * * *